US010828682B2

(12) United States Patent
Lazaro

(10) Patent No.: US 10,828,682 B2
(45) Date of Patent: Nov. 10, 2020

(54) IMMERSION/SPRAY RINSE SYSTEM AND METHODS OF USE

(71) Applicant: HARDWOOD LINE MANUFACTURING CO., Chicago, IL (US)

(72) Inventor: Anton Ernest Lazaro, Evanston, IL (US)

(73) Assignee: Hardwood Line Manufacturing Co., Chicago, IL (US)

( * ) Notice: Subject to any disclaimer, the term of this patent is extended or adjusted under 35 U.S.C. 154(b) by 291 days.

(21) Appl. No.: 15/900,017

(22) Filed: Feb. 20, 2018

(65) Prior Publication Data

US 2018/0236509 A1 Aug. 23, 2018

Related U.S. Application Data

(60) Provisional application No. 62/462,088, filed on Feb. 22, 2017.

(51) Int. Cl.

| | |
|---|---|
| ***B08B 9/08*** | (2006.01) |
| ***B08B 3/04*** | (2006.01) |
| ***B08B 3/14*** | (2006.01) |
| ***B08B 3/02*** | (2006.01) |
| ***B08B 3/06*** | (2006.01) |

(52) U.S. Cl.

CPC ..... *B08B 9/0813* (2013.01); *B08B 3/02* (2013.01); *B08B 3/042* (2013.01); *B08B 3/045* (2013.01); *B08B 3/06* (2013.01); *B08B 3/14* (2013.01); *B08B 9/08* (2013.01); *B08B 9/0826* (2013.01); *B08B 2209/08* (2013.01)

(58) Field of Classification Search
None
See application file for complete search history.

(56) References Cited

U.S. PATENT DOCUMENTS

| | | | | |
|---|---|---|---|---|
| 4,790,904 | A | 12/1988 | Yates | 159/16.1 |
| 5,063,949 | A | 11/1991 | Yaes | 134/60 |
| 5,139,039 | A | 8/1992 | Yates | 134/95.1 |
| 5,194,095 | A | 3/1993 | Yates | 134/10 |
| 5,421,883 | A | 6/1995 | Bowden | 118/73 |
| 5,707,457 | A | 1/1998 | Yates | 134/30 |
| 5,782,252 | A * | 7/1998 | Lewis | B08B 3/06 134/103.1 |
| 5,829,459 | A * | 11/1998 | Milocco | A47L 15/4291 134/57 D |
| 6,328,814 | B1 | 12/2001 | Fishkin et al. | 134/30 |
| 6,702,895 | B1 | 3/2004 | Lazaro | 118/418 |

FOREIGN PATENT DOCUMENTS

FR 2524909 A1 * 10/1983 ..... B08B 3/12

OTHER PUBLICATIONS

English Machine Translation of FR 2524909 A1.*
www.sterlingsystems.com.
www.tscherwitschke.com.

* cited by examiner

*Primary Examiner* — Nicole Blan
(74) *Attorney, Agent, or Firm* — J. Peter Paredes; Rosenbaum IP, P.C.

(57) ABSTRACT

Provided herein are systems, methods and apparatuses for an immersion and spray rinsing system comprising a tank with improved cleanliness of the parts between immersion and spray.

6 Claims, 15 Drawing Sheets

IMMERSION/SPRAY RINSE SYSTEM AND METHODS OF USE

CROSS-REFERENCE TO RELATED APPLICATIONS

The present application claims priority from U.S. provisional application Ser. No. 62/462,088, filed on Feb. 22, 2017, herein incorporated by reference in its entirety.

BACKGROUND

The invention generally relates to immersion rinsing and spray rinsing.

Immersion rinsing and spray rinsing are techniques used by every metal finisher as process chemistry needs to be rinsed off the parts before those parts are moved between processes. The RinseMaster® (U.S. Pat. No. 6,702,895) only utilized spray rinsing while achieving the water savings equivalent to a 5 station counterflow rinse. While 99% of all metal finishers utilize immersion rinsing to some degree, some also spray rinse along with immersion but separate tanks are used. Immersion rinsing is the easiest way to rinse plus you have exponential savings for every additional rinse station added.

In one embodiment, basic rinsing is by immersion or counterflow rinsing. After the barrel has been immersed in a process chemistry, the barrel is always rinsed before moving to the next process tank. Not doing so increases cross contamination which then reduces a specific chemistry from doing its job which then adversely affects good adhesion, a byproduct of plating. Typical barrels are usually immersed in either 1, 2, 3 or more (usually no more than 3) counterflow rinse tanks where contamination is exponentially reduced by the number of rinse stations. There is an exponential relationship between using less water and more rinse tanks to achieve the same rinse ratio. An immersion rinse tank is defined as a tank filled with water which has a fresh water supply on one side and a weir on the other. Water is brought into the tank at a rate which dissolves the contamination to a point where parts are thought clean enough to move on to the next process.

A product called the RinseMaster® (RM) offers the equivalent of a 5 station counterflow rinse in one station yet it's actually better than a 5 station counterflow rinse tank in that the final rinse is fresh water rather than the concentration (however small) in the 5th tank. The philosophy of a RM has 3 counterflow rinses and 2 recirculation sprays. Example: we will move 10 gallons of water per rinse through a RM. There are (2) tanks inside the RM cabinet which is off line. Tank 2 is the 'dirtiest' while tank 1 is the cleanest, 1$^{st}$ rinse sprays 10 gallons from tank 2 over the barrel then sends that 10 gallons to waste water treatment (WWT). The 2nd rinse is a recirculation of the remaining water in tank 2. The 3rd rinse is a counterflow where 10 gallons is taken from tank 1, sprayed over the barrel and return to tank 2. The 4th rinse is a recirculation of the remaining water in tank 1. The 5th rinse takes 10 gallons of fresh water, sprays it over the barrel returning to tank 1. While the RM is superior to traditional immersion rinsing, the RM is costly and has many moving parts which are difficult for some people to understand.

The present invention solves these problems as well as others.

SUMMARY OF THE INVENTION

Provided herein are systems, methods and apparatuses for an immersion and spray rinsing system comprising a tank with improved cleanliness of the parts between immersion and spray. The immersion spray and rinse system generally comprises a rinse tank operably coupled with a plurality of valves, a pump, a holding tank and a Programmable Logic Controller (PLC); the rinse tank including a receiver and a bracket for receiving a barrel, and the rinse tank including a spray system for spraying the barrel; the holding tank stores contaminated rinse water and includes an overflow drain, a water sensor to sense the level of water in the holding tank; the PLC controls the pump and the plurality of valves to direct water back and forth from the holding tank to the rinse tank and to a waste tank.

A method of immersing and spraying a barrel is disclosed and generally comprises: disposing a barrel into a rinse tank and partially flooding the rinse tank to a height F with contaminated water; revolving the barrel in contaminated rinse water for a first rinse; discharging a counterflow volume W to a waste stream; discharging the remainder of volume H in the rinse tank to a holding tank; spraying a first water spray over the inside of the barrel; spraying a second water spray over the inside of the barrel; removing the barrel from the tank; and pumping a portion of contaminated water in the holding tank back to the rinse tank.

The methods, systems, and apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is to be understood that both the foregoing general description and the following detailed description are exemplary and explanatory only and are not restrictive of the methods, apparatuses, and systems, as claimed.

BRIEF DESCRIPTION OF THE DRAWINGS

In the accompanying figures, like elements are identified by like reference numerals among the several preferred embodiments of the present invention.

DETAILED DESCRIPTION OF THE INVENTION

Figure 1:
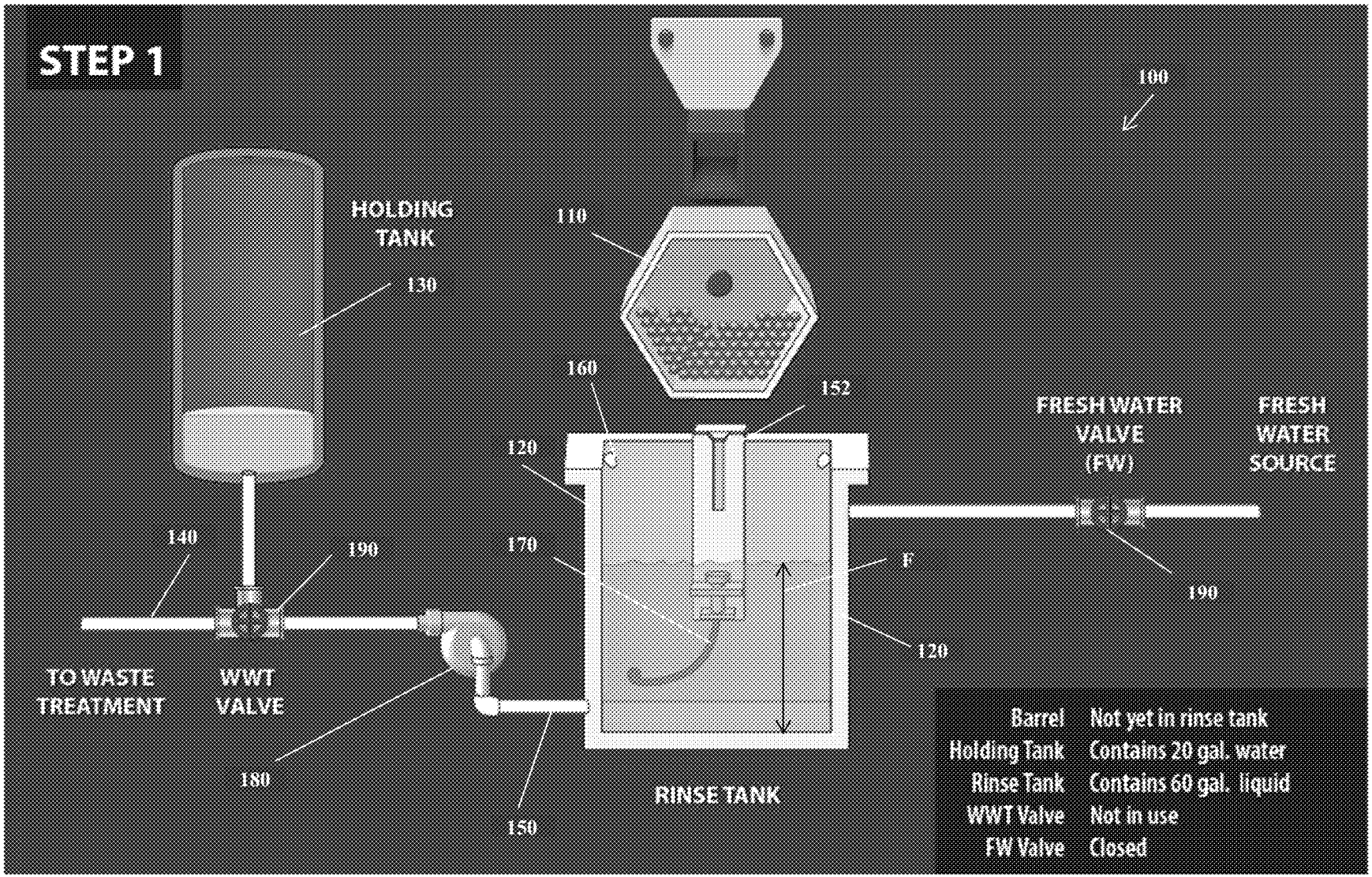
FIG. 1 is a schematic diagram of the immersion and spray rinse system displaying the barrel not yet in the rinse tank and the holding tank and rinse tank containing liquid with the FW valve closed.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Embodiments of the invention will now be described with reference to the Figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein. The words proximal and distal are applied herein to denote specific ends of components of the instrument described herein. A proximal end refers to the end of an instrument nearer to an operator of the instrument when the instrument is being used. A distal end refers to the end of a component further from the operator and extending towards the surgical area of a patient and/or the implant.

The use of the terms "a" and "an" and "the" and similar referents in the context of describing the invention are to be construed to cover both the singular and the plural, unless otherwise indicated herein or clearly contradicted by context. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Recitation of ranges of values herein are merely intended to serve as a shorthand method of referring individually to each separate value falling within the range, unless otherwise indicated herein, and each separate value is incorporated into the specification as if it were individually recited herein. The word "about," when accompanying a numerical value, is to be construed as indicating a deviation of up to and inclusive of 10% from the stated numerical value. The use of any and all examples, or exemplary language ("e.g." or "such as") provided herein, is intended merely to better illuminate the invention and does not pose a limitation on the scope of the invention unless otherwise claimed. No language in the specification should be construed as indicating any nonclaimed element as essential to the practice of the invention.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As used herein the term "method" refers to manners, means, techniques and procedures for accomplishing a given task including, but not limited to, those manners, means, techniques and procedures either known to, or readily developed from known manners, means, techniques and procedures by one of ordinary skill in the art.

As shown in FIGS. 1-6, the immersion spray and rinse system comprises a single tank which serves as an immersion rinse and a fresh water spray rinse operably coupled with a plurality of valves, a pump, a holding tank and a Programmable Logic Controller (PLC). The immersion rinse system 100 comprises the steps of: disposing a barrel 110 into a rinse tank 120, which is partially flooded to F with water; revolving the barrel 110 in contaminated rinse water for a $1^{st}$ rinse; discharging a counterflow volume W to a waste barrel 140; discharging the remainder of H volume in the rinse tank 120 to the holding tank 130; spraying a 1st of two fresh water sprays over barrel or rack 2nd rinse; spraying a $2^{nd}$ of two fresh water sprays over the barrel or rack $3^{rd}$ rinse; removing the barrel from the tank; pumping the contents of contaminated water in the holding tank back to the rinse tank; charging the rinse tank with F volume awaiting next barrel or rack.

The immersion spray and rinse system includes a process whereby a single rinse tank is provided to offer more efficient rinsing than what is now done traditionally in three counterflow rinse tanks. The immersion spray and rinse system leaves the barrel with a fresh water spray rather than with the concentration of that contained in a traditional three station counterflow rinse tank.

Figure 5:
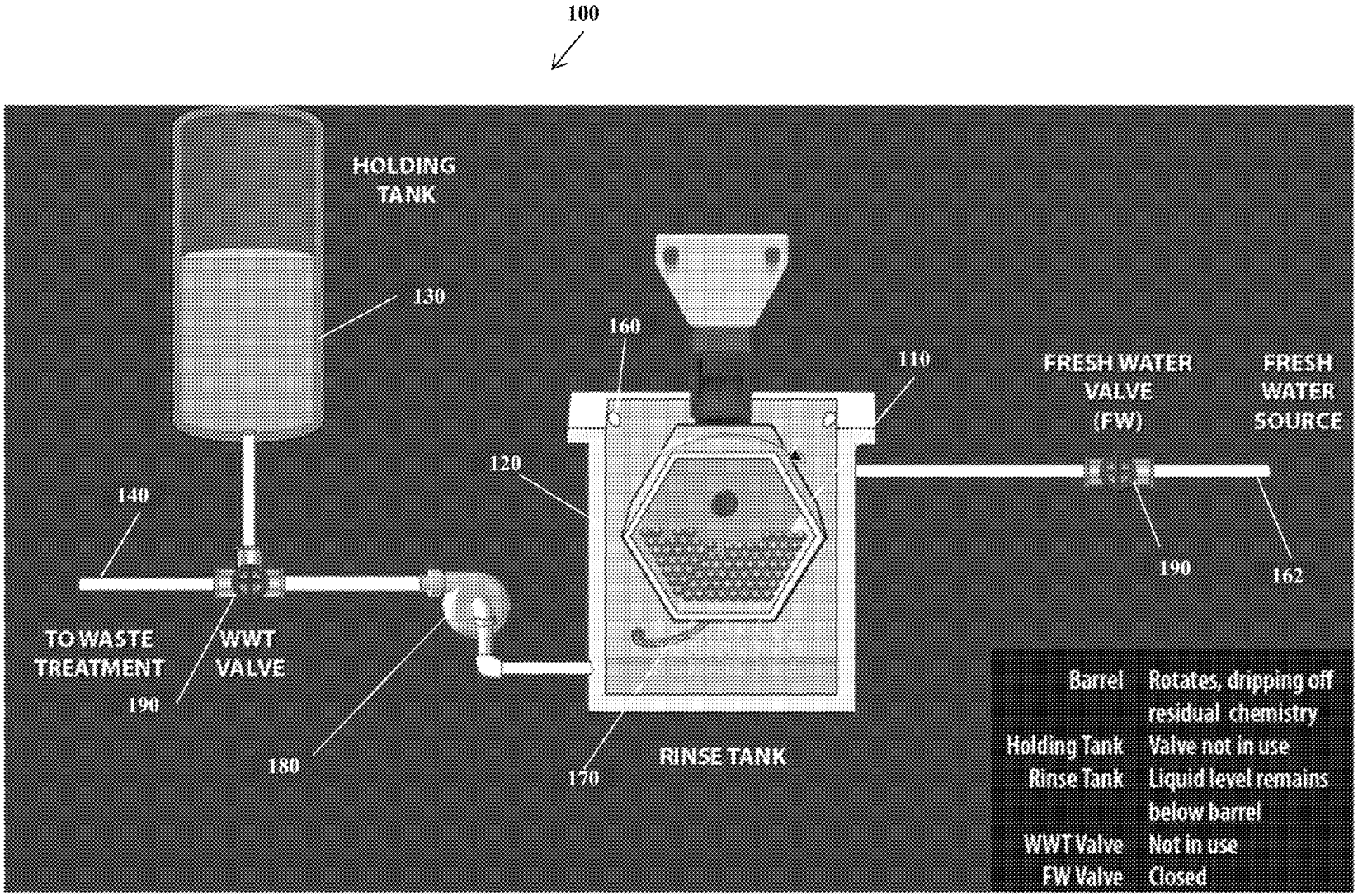
FIG. 5 is a schematic diagram of the immersion and spray rinse system where the barrel rotates and drips off residual chemistry, the holding tank valve is not in use, the rinse tank includes a liquid level that remains below the barrel, and the FW valve is closed.
Figure 6:
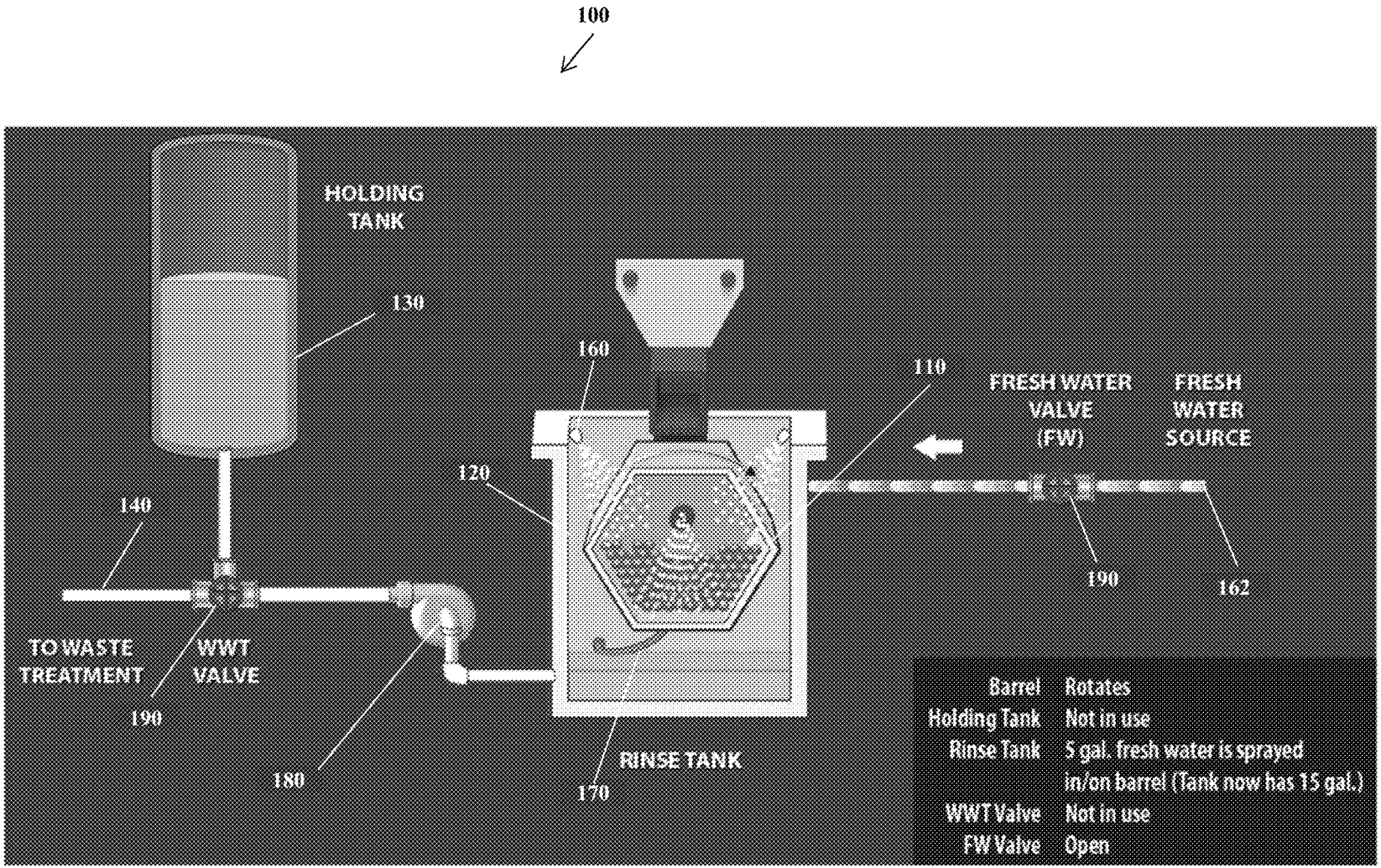
FIG. 6 is a schematic diagram of the immersion and spray rinse system displaying the second rinse, where the barrel rotates, the holding tank is not in use, the rinse tank includes fresh water sprayed in/on the barrel from the fresh water valve that is open, and the WWT valve is not in use.
Figure 7:
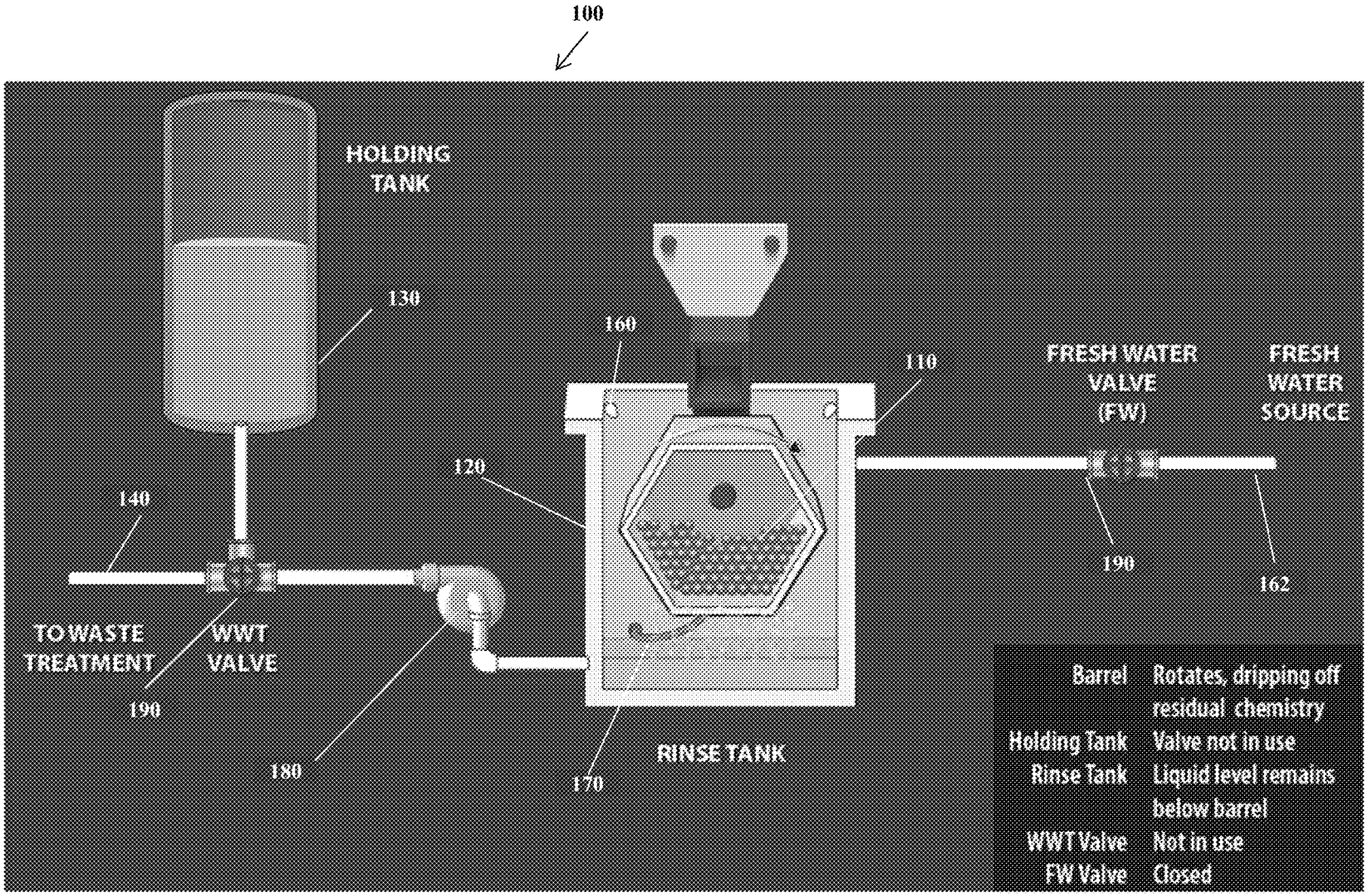
FIG. 7 is a schematic diagram of the immersion and spray rinse system where the barrel rotates, dripping off residual chemistry, the holding tank valve is not in use, the liquid level in the rinse tank remains below the barrel and the FW valve is close.

As shown in FIGS. 1-11, the Rinse Tank 120 is the receiver for the barrel and where rinsing takes place. The Rinse Tank 120 is positioned in a processing line 150 like all others under a manual or automatic hoist and next to its process tank, the rinse system can only work with a patented SprayThru (ST) barrels and requires a Z bracket 152 of which allows the barrel to be coupled with a spray system 160, as shown in FIG. 7. The Z bracket 152 is part of the rinse tank 120 and extends down from a V saddle to a pre-determined height where it turns 90 degrees inward. The Z bracket 152 includes a lower shelf that supports a spring loaded male connector 154 and allows the barrel's female connector to accept flow from an outside source, such as water. Water is allowed to travel through a hose 170, through the Z bracket into a machined passageway of the barrel's superstructure to inside the barrel and onto the parts to be rinsed. Traditional barrels either by HLM or by others without such spray means cannot work with this design as it requires spraying of fresh water. The Rinse Tank has high and low limits, openings, a Z bracket for mating with the ST barrel and upper spray heads for rinsing the outside of the barrel.

Figure 2:
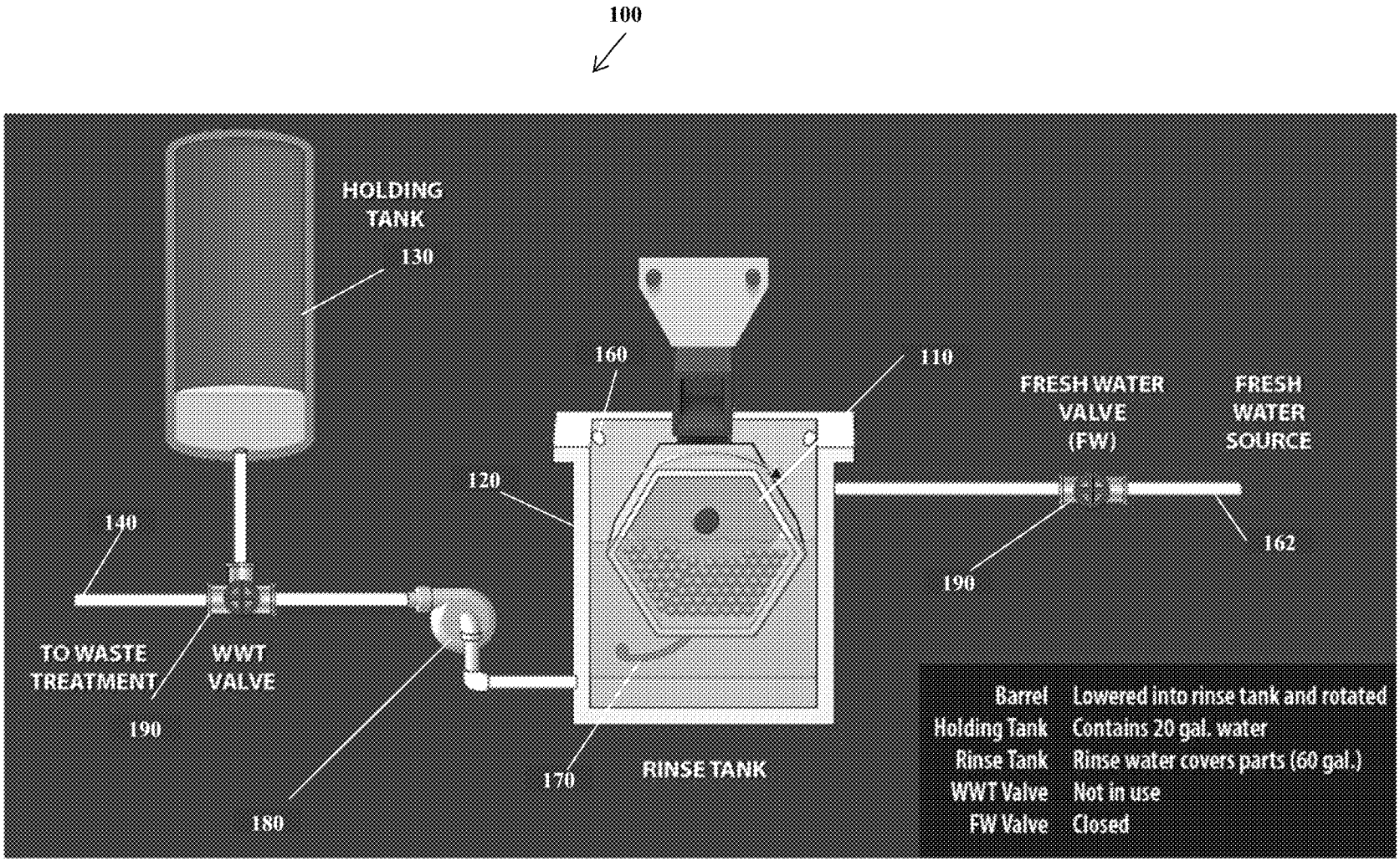
FIG. 2 is a schematic diagram of the immersion and spray rinse system where the barrel is lowered into the rinse tank and rotated and rinse water covers the parts within the barrel with the FW valve closed.
Figure 3:
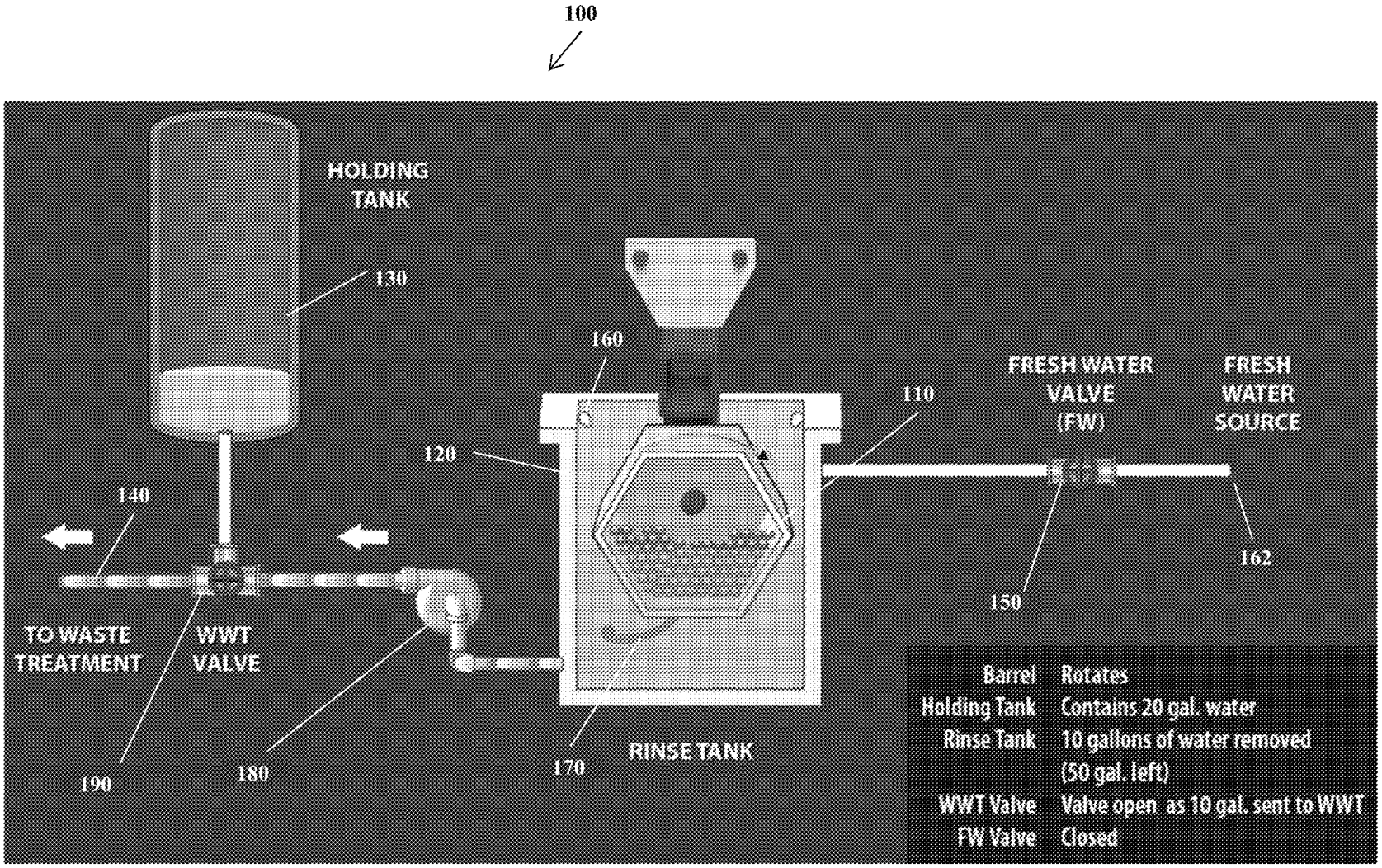
FIG. 3 is a schematic diagram of the immersion and spray rinse system displaying the 1$^{st}$ rinse or immersion where the barrel rotates and water is removed from the rinse tank with the WWT valve opening to permit water into the holding tank and the FW valve is closed.
Figure 4:
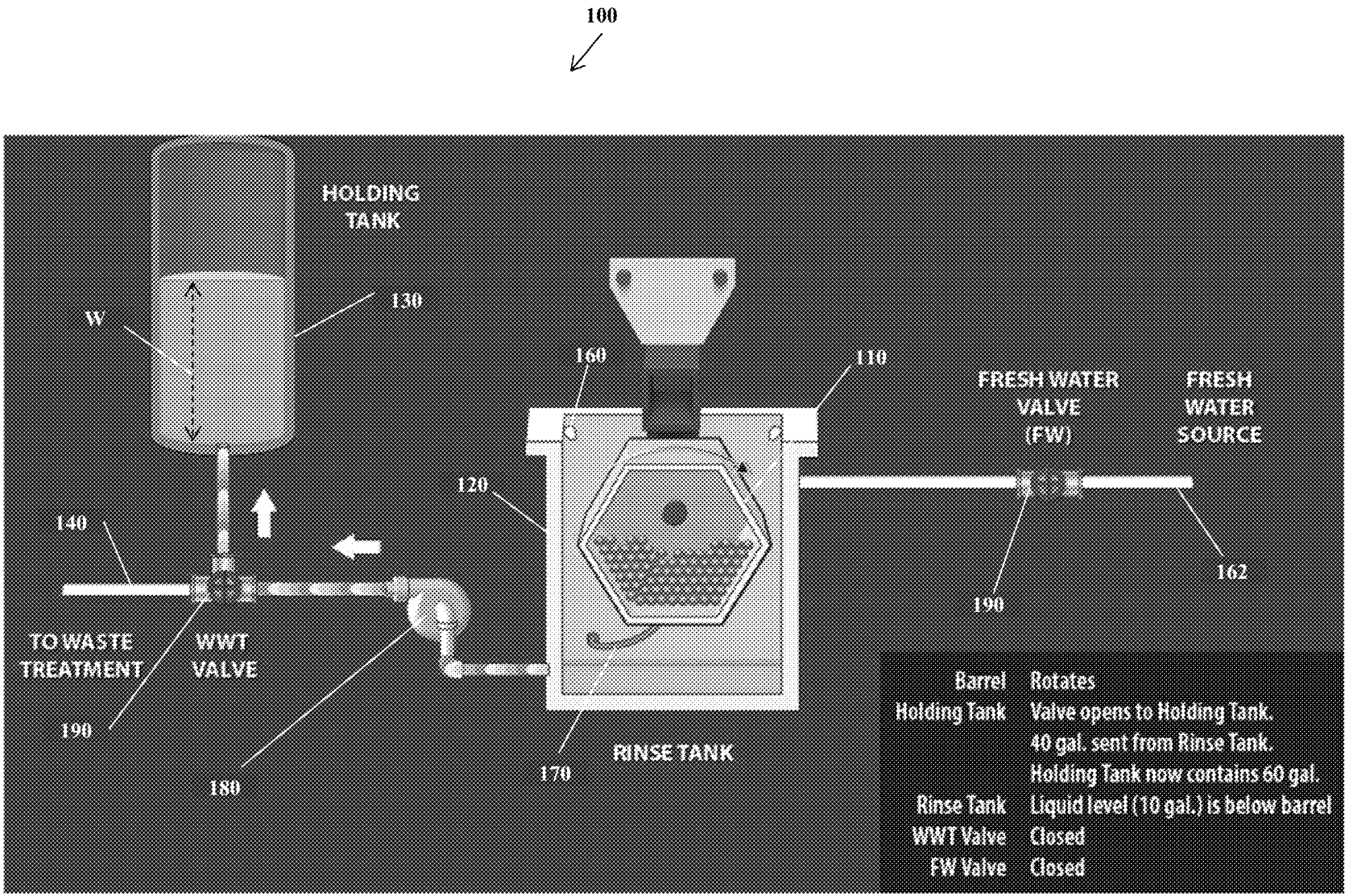
FIG. 4 is a schematic diagram of the immersion and spray rinse system where the barrel rotates and the valve opens to holding tank to send water into the holding tank and the liquid level is below the barrel with the WWT and FW valve closed.

According to one embodiment, FIG. 1 is displaying step 1, where the barrel not yet in the rinse tank and the holding tank and rinse tank containing liquid with the FW valve closed. FIG. 2 shows step 2 of the immersion and spray rinse system where the barrel is lowered into the rinse tank and rotated and rinse water covers the parts within the barrel with the FW valve closed. FIG. 3 shows step 3 of the immersion and spray rinse system displaying the 1$^{st}$ rinse or immersion where the barrel rotates and water is removed from the rinse tank with the WWT valve opening to permit water into the holding tank and the FW valve is closed. FIG. 4 shows step 4 of the immersion and spray rinse system where the barrel rotates and the valve opens to holding tank to send water into the holding tank and the liquid level is below the barrel with the WWT and FW valve closed.

According to one embodiment, FIG. 5 shows step 5 of the immersion and spray rinse system where the barrel rotates and drips off residual chemistry, the holding tank valve is not in use, the rinse tank includes a liquid level that remains below the barrel, and the FW valve is closed. FIG. 6 shows step 6 of the immersion and spray rinse system displaying the second rinse, where the barrel rotates, the holding tank is not in use, the rinse tank includes fresh water sprayed in/on the barrel from the fresh water valve that is open, and the WWT valve is not in use. FIG. 7 shows step 7 of the immersion and spray rinse system where the barrel rotates, dripping off residual chemistry, the holding tank valve is not in use, the liquid level in the rinse tank remains below the barrel and the FW valve is close.

Figure 8:
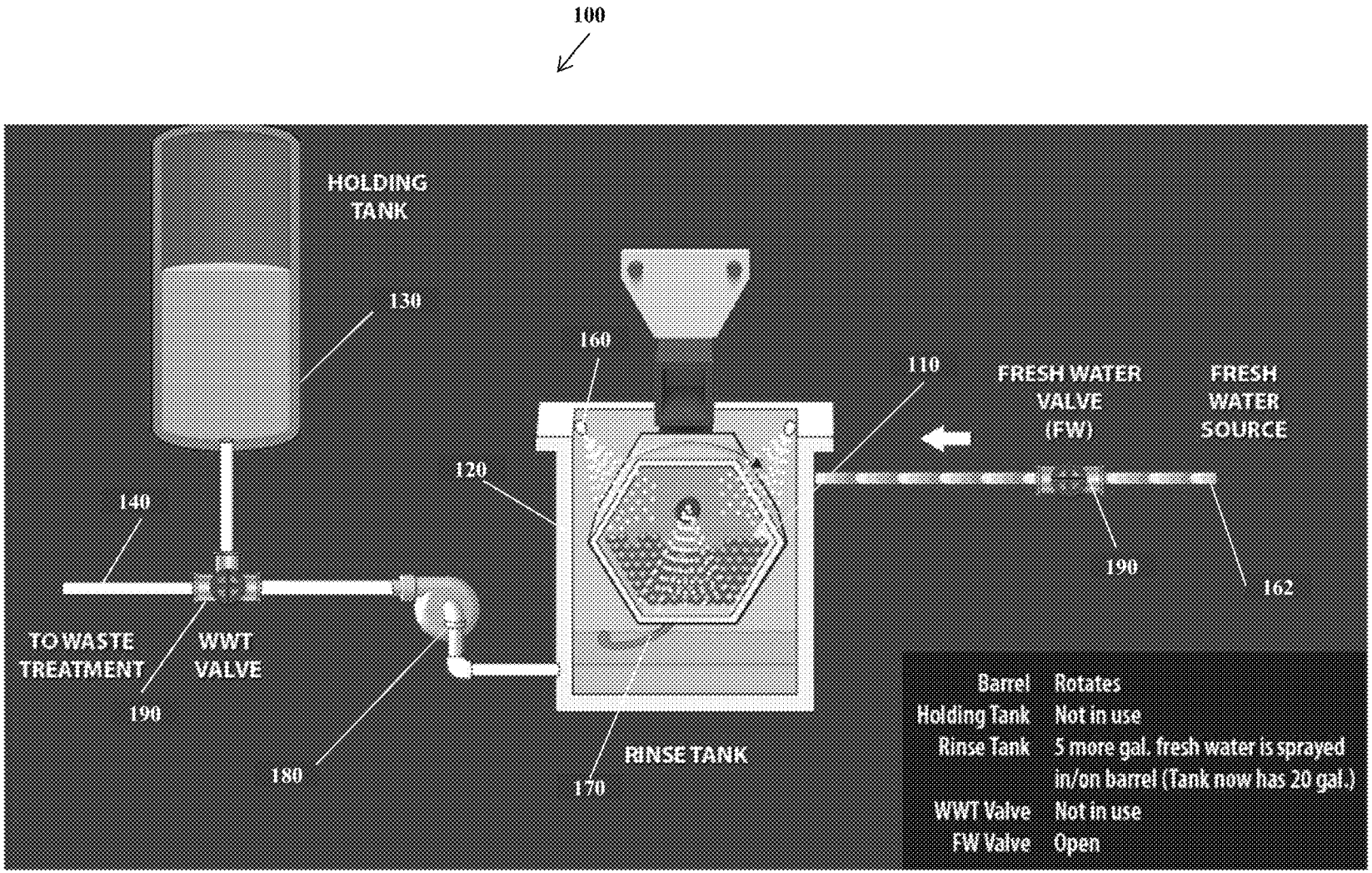
FIG. 8 is a schematic diagram of the immersion and spray rinse system displaying the third rinse, where the barrel rotates, the holding tank is not in use, the rinse tank includes fresh water sprayed in/on the barrel from the fresh water valve that is open, and the WWT valve is not in use.
Figure 9:
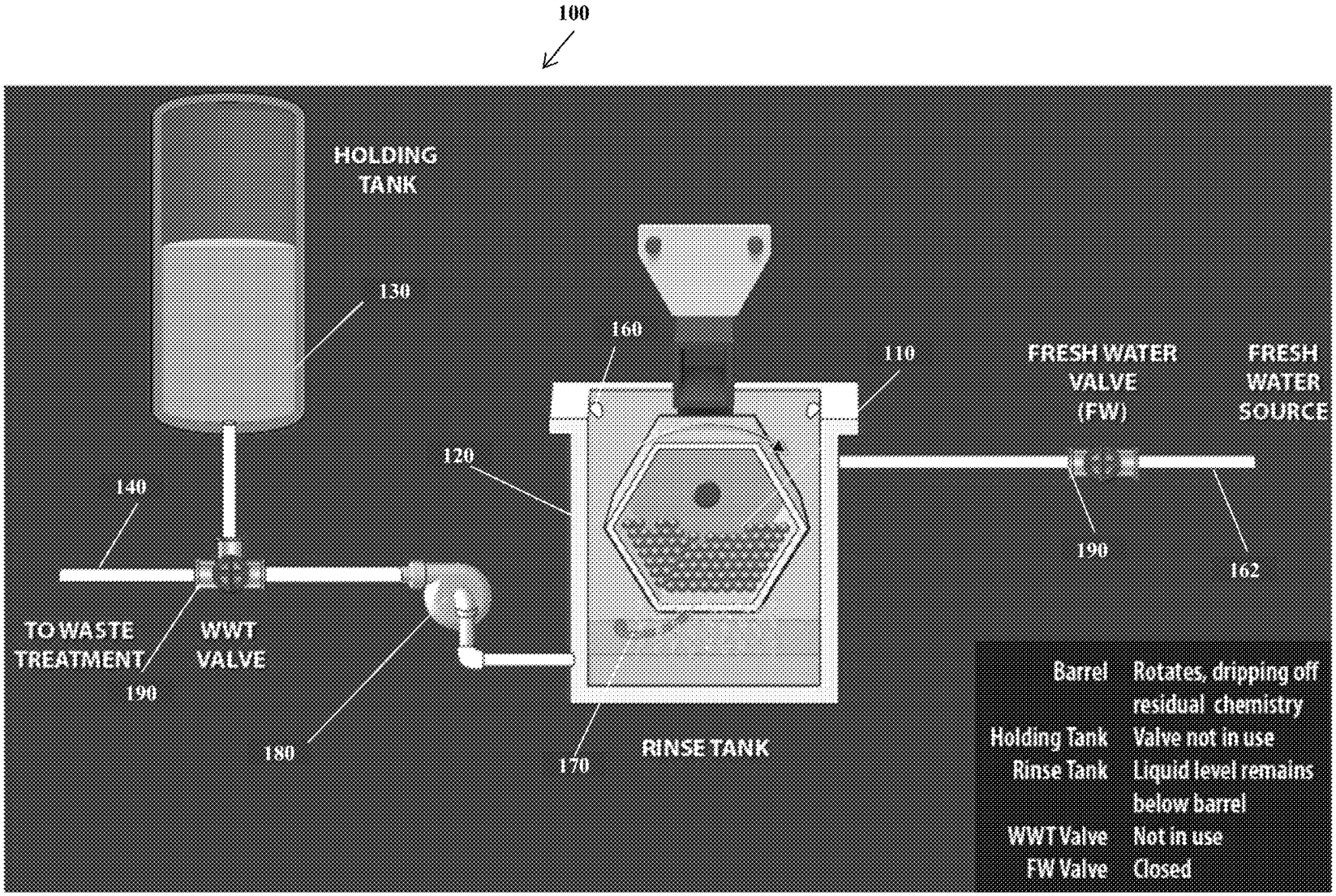
FIG. 9 is a schematic diagram of the immersion and spray rinse system where the barrel rotates, dripping off residual chemistry, the holding tank valve is not in use, the liquid level in the rinse tank remains below the barrel and the FW valve is close.

According to one embodiment, FIG. 8 shows step 8 of the immersion and spray rinse system displaying the third rinse, where the barrel rotates, the holding tank is not in use, the rinse tank includes fresh water sprayed in/on the barrel from the fresh water valve that is open, and the WWT valve is not in use. FIG. 9 shows step 9 of the immersion and spray rinse system where the barrel rotates, dripping off residual chemistry, the holding tank valve is not in use, the liquid level in the rinse tank remains below the barrel and the FW valve is close.

Figure 10:
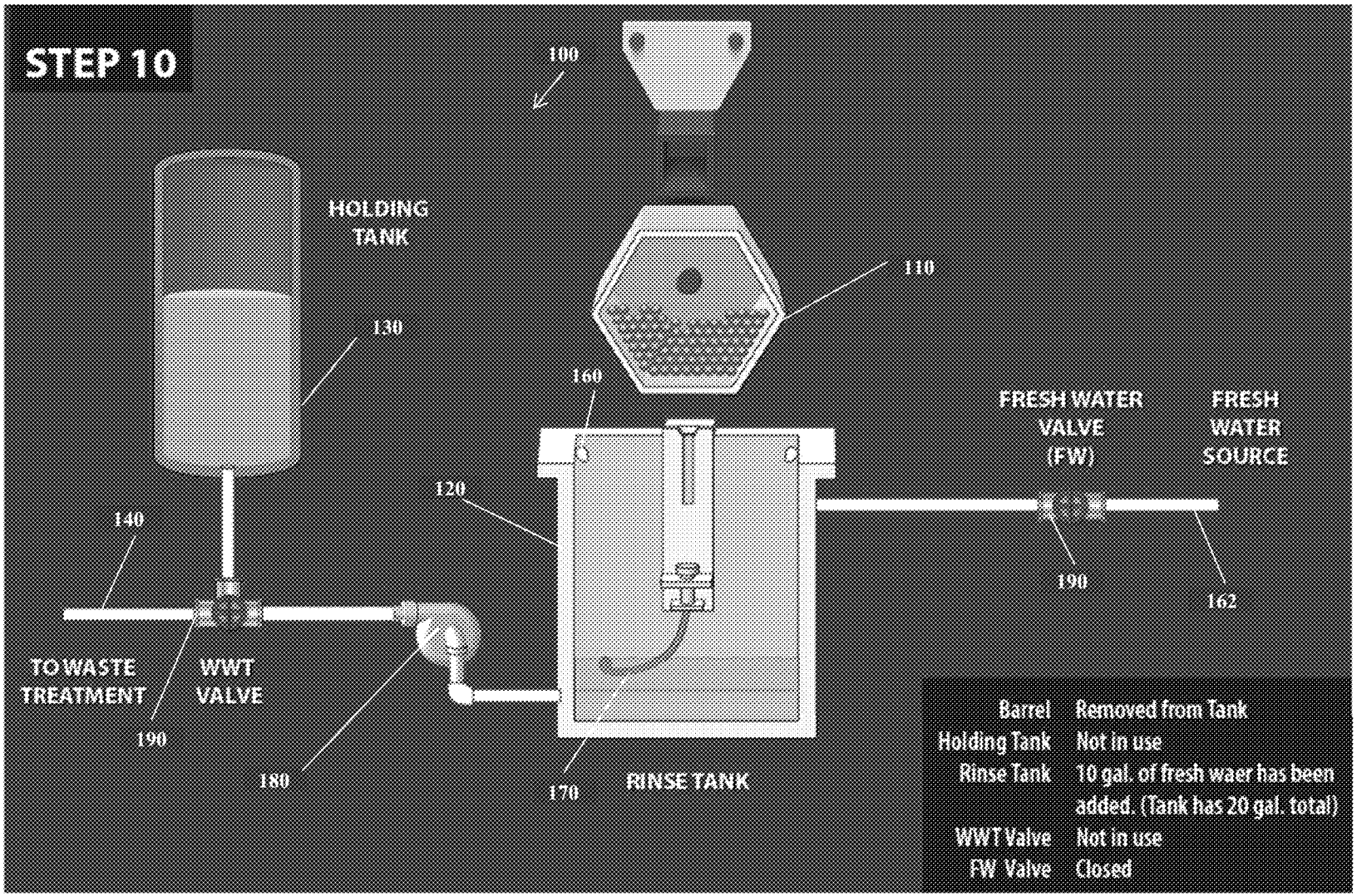
FIG. 10 is a schematic diagram of the immersion and spray rinse system where the barrel is removed from the rinse tank, the holding tank valve is not in use, the fresh water has been added to the rinse tank, and the FW valve is close.
Figure 11:
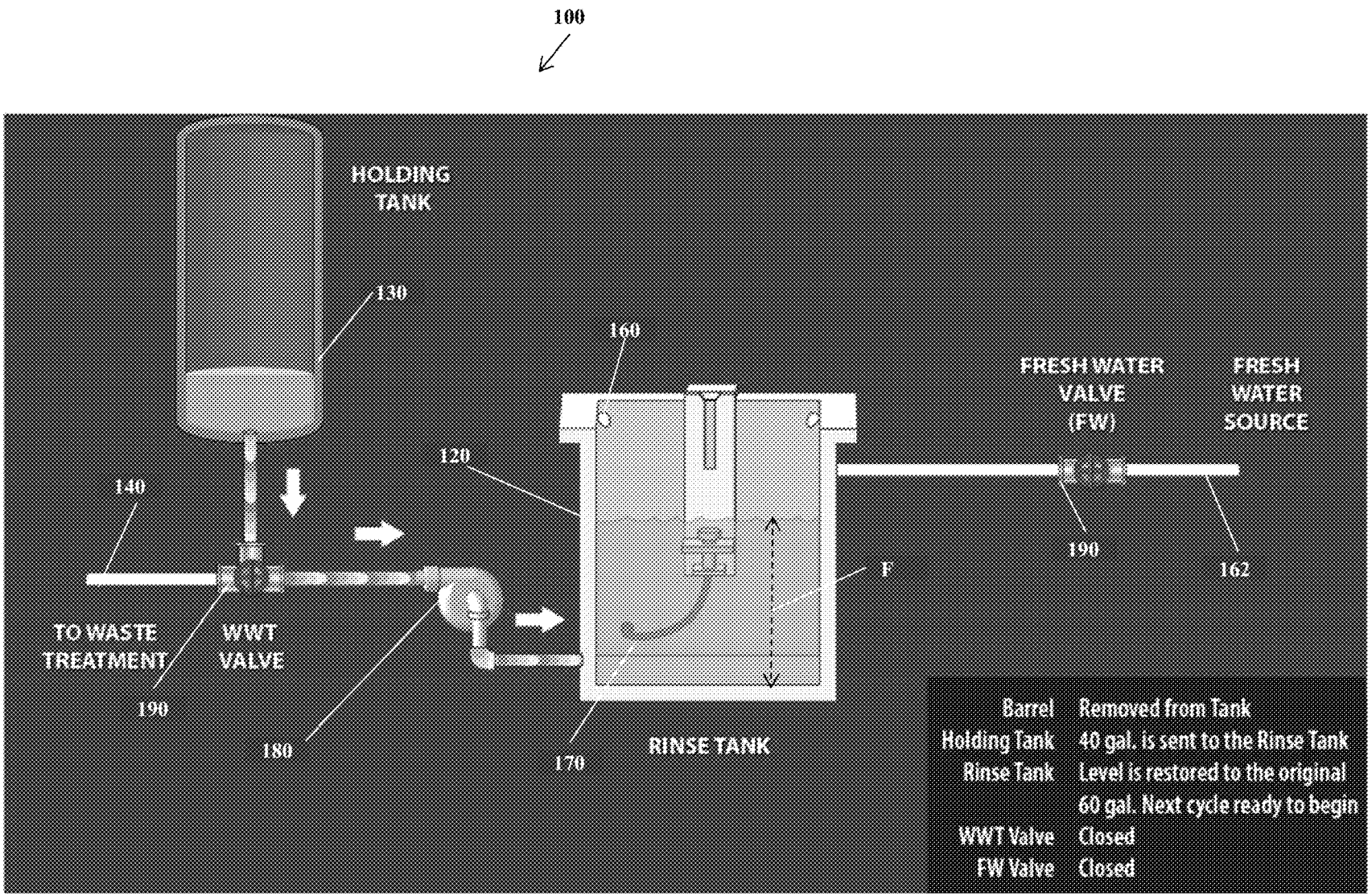
FIG. 11 is a schematic diagram of the immersion and spray rinse system where the barrel is removed from the rinse tank, the holding tank sends water back to the rinse tank, the liquid level in the rinse tank is restored to the original level and the FW valve is close.

According to one embodiment, FIG. 10 shows step 10 of the immersion and spray rinse system where the barrel is removed from the rinse tank, the holding tank valve is not in use, the fresh water has been added to the rinse tank, and the FW valve is close. FIG. 11 shows step 11 of the immersion and spray rinse system where the barrel is removed from the rinse tank, the holding tank sends water back to the rinse tank, the liquid level in the rinse tank is restored to the original level and the FW valve is close.

Figure 12:
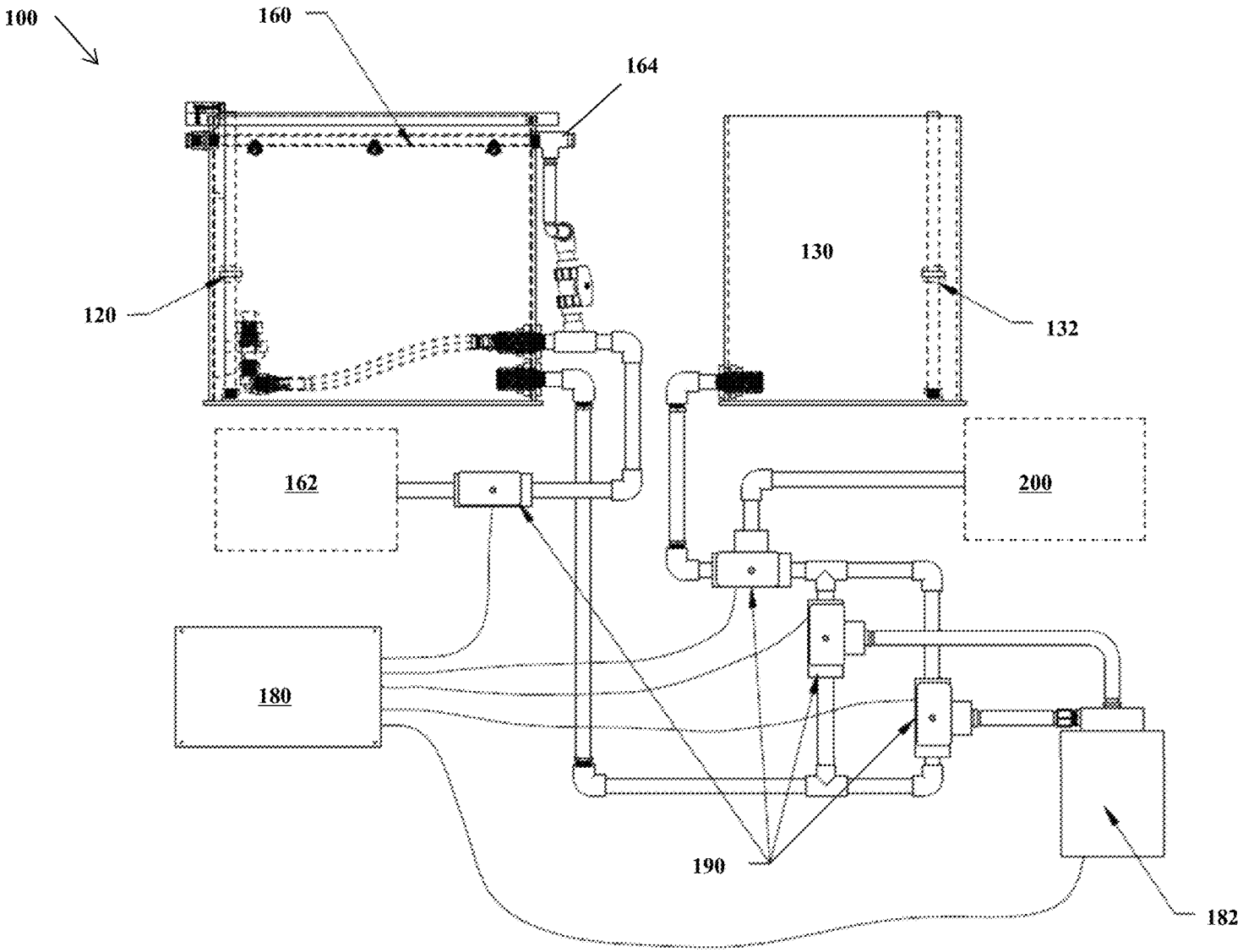
FIG. 12 is a schematic diagram of the immersion and spray rinse system without the barrel disposed in the holding tank.
Figure 13:
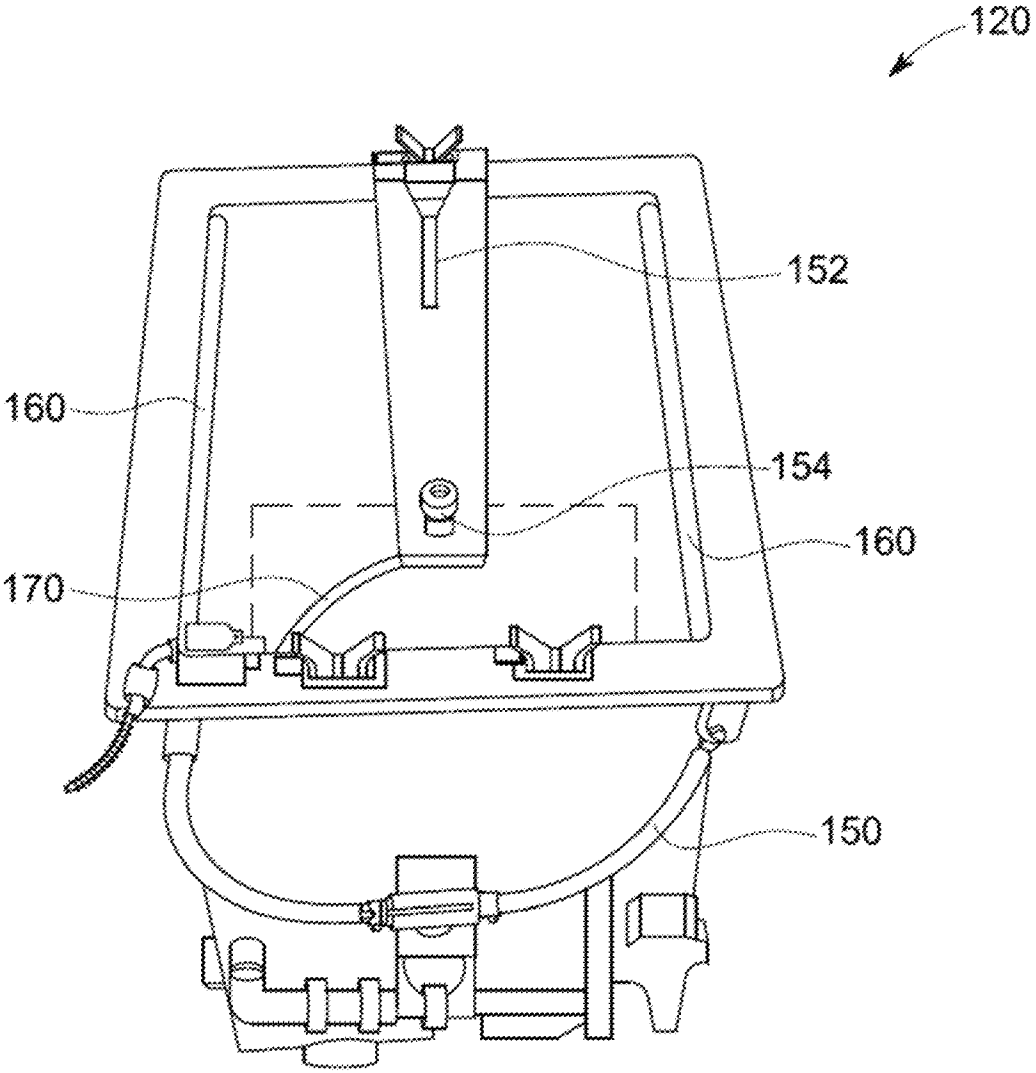
FIG. 13 is a top perspective view of the rinse tank including the Z bracket.
Figure 14:
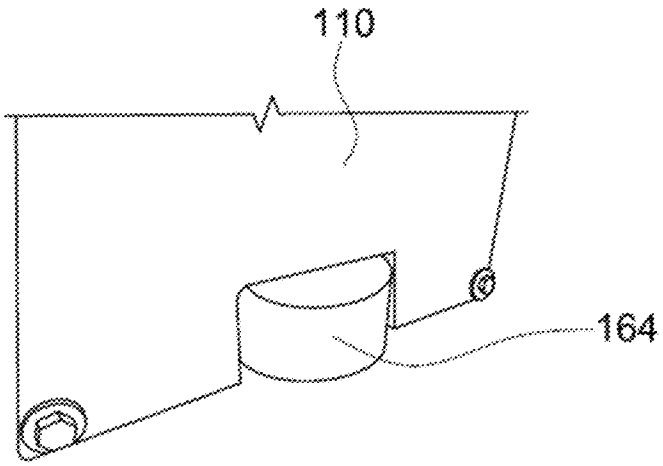
FIG. 14 is a side view of the connector.
Figure 15A:
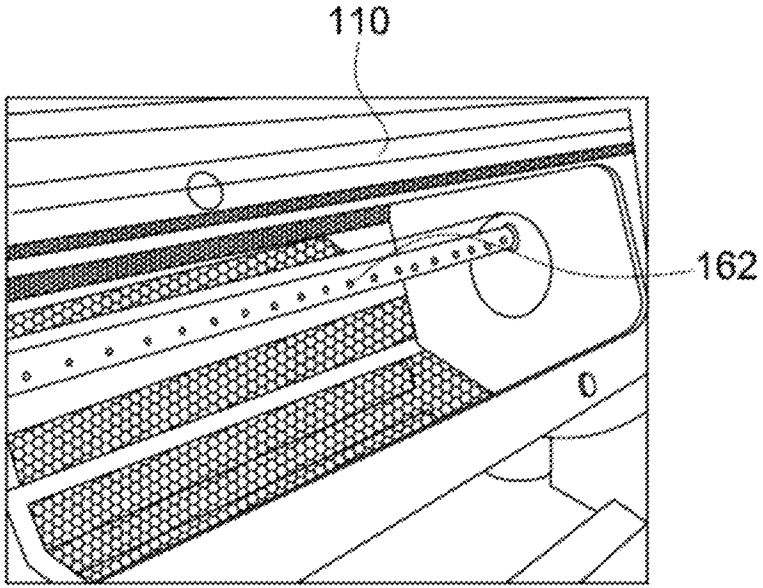
FIG. 15A is an interior view of the barrel showing one embodiment of the spray system.
Figure 15B:
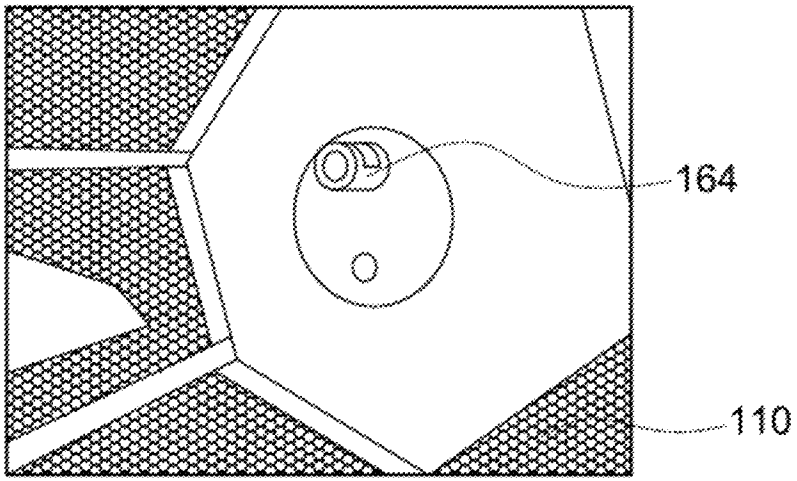
FIG. 15B is an interior view of the barrel showing another embodiment of the spray system.

In one embodiment, the barrel 110 is a HLM ST barrel that will work in this system. As shown in FIGS. 12 and 14, the ST barrel 110 includes a connector 164, a passageway and spray system 160 which allows fresh water from an outside source 162 to be channeled through the barrel's superstructure and into the parts to be rinsed. The ST connector 164 is the female part of the connection and on the barrel and it is positioned at the underside of the hangerarm. The connector 164 has an inner geometry which mates with the male connector 154 on the spring loaded Z bracket. The spray system 160 may include two embodiments, as shown in FIGS. 15A-15B, where a spray bar 162 is coaxially disposed through the barrel. The spray bar 160 includes a series of uniformly drilled downward facing perforations that sprays at least across the cylinders length. As shown in FIG. 15B, the spray system 160 may include a spray cap 164 that engages into the fixed shaft that then sprays across the load of the barrel 110. In one embodiment, the spray cap 164 is used in shorter length barrel cylinders. The spraying action allows the work or parts to come in contact with the water spray. In one embodiment, the spray system includes a spray rinse manifold.

In one embodiment, the Holding Tank 130 is an off-line tank used to store contaminated rinse water which is constantly turned over after each process. This Holding Tank 130 includes an overflow drain 140 for safety and in case a valve 190 does not open or close. The holding tank can also include a water sensor 132 to sense the level of water in the holding tank, as shown in FIG. 12. A PLC controlled pump 182 directs water back and forth from the holding tank to the rinse and to Waste Water Treatment (WWT) 200. The Holding Tank has capacity for maximum amount of counterflow water, openings for water transfer and a weir piped to WWT 200. A pump is provided to move water back and forth between the Rinse Tank and Holding Tank. The valves 190 are positioned along the connections which allow precise amounts of water to be moved between the Holding Tank 130 and Rinse Tank 166.

The PLC 180 sends instructions for how long a valve 190 stays open and in what direction the pump 182 must push water. The programmable logic controller (PLC), or programmable controller is an industrial digital computer which has been adapted for the control of manufacturing processes, such as assembly lines, or robotic devices, or any activity that requires high reliability control and ease of programming and process fault diagnosis.

The rinsing system 100 works by having the rinse tank 120 prefilled to a given height with water, the ST barrel is delivered to the tank and the process begins. The PLC 180 controls all moves of water flow. First, the barrel rotates in the water for an immersion rinse. After a pre-determined period of time, a precise amount of water is pumped from the rinse tank to WWT. The amount of water lost to WWT will be made up with fresh sprayed water. Second, a volume of immersion water is then pumped to the holding tank leaving a space W between the bottom of the barrel and the water level in the rinse tank. Third, the barrel continues rotating as 50% of water which was sent to WWT is now brought in as the first of two fresh water sprays. Fourth, the barrel is allowed to drip off then the second or remaining 50% of fresh water is sprayed over and into the rotating barrel. The barrel again is allowed to drip off and the hoist removes the barrel from the tank. Fifth, as soon as the barrel leaves, water from the holding tank is pumped back to the rinse tank. The process begins again with another barrel entering the tank.

The immersion spray and rinse system accomplishes as good a rinse as a RM while using more water, however, less water than traditional immersion rinsing plus the parts become cleaner. The immersion spray and rinse system, like the RM saves time and space as the barrel never leaves the tank. Doing all rinsing in one tank frees up crane time which in some cases reduces the number of cranes. The immersion spray and rinse system utilizes the same ST barrel and single station tank design as with RM but does it for less the cost and without the complexity. In fact, it would take a series of at least three tanks containing cleaner and cleaner water to equal the dilution ratio achieved by this system as the final spray is fresh water.

The immersion spray and rinse system saves water, space, time and operating expense. The immersion spray and rinse system reuses water. The immersion spray and rinse system only requires a single tank slot while an immersion process of equal water quantity requires three tank slots. The immersion spray and rinse system does not include a hoist that leaves the barrel in this device allowing it to perform the previously stated 9 steps as opposed to counterflow rinse tanks where a hoist is required to move the barrel from tank-to-tank. This device is not as efficient as a RM (which only sprays) in terms of water usage however It offers an immersion and double spray rinse in one tank. As the water in the holding tank is being constantly turned over makes this device much more efficient than an immersion rinse or a spray rinse.

The immersion spray and rinse system moves water from one place to another which results in cleaner parts. A PLC 180 controls a pump and valves 190 situated between the rinse tank and holding tank. The rinse tank is where the immersion and spray rinse take place. The holding tank is where water is stored in between barrel moves. Whatever amount of water is brought in as fresh is exactly the amount that is discharged but not before it mixes with the remaining water in the holding tank. A valve is a device that regulates, directs or controls the flow of a fluid (gases, liquids, fluidized solids, or slurries) by opening, closing, or partially obstructing various passageways. Valves are technically fittings, but are usually discussed as a separate category. In an open valve, fluid flows in a direction from higher pressure to lower pressure.

The immersion/spray and rinse system works with both immersion and spray rinsing being accomplished in sequential order.

The immersion/spray and rinse system has a barrel that sprays from the inside of which is a patented HLM product. The immersion/spray rinse system combines 2 different forms of rinsing, immersion and spray in one tank. While bath turnover constantly takes place, chemistry concentrations remain the same in the immersion spray and rinse system as long as drag-out remains constant.

In an alternative embodiment, the system would require a barrel to have the ability to allow a liquid, whether it be water or process chemistry, to pass from an outside source or from the tank itself through the barrel structure and into the cylinder spraying directly onto the parts. Attempting to push water through the barrel's perforations from the outside in, which cover about 25% of the total open area, while the cylinder is rotating is ineffective plus it would push any trapped contamination back inside the cylinder. This is contrary to the other embodiment, which has the perforations acting as openings for water to pass out from and away from the parts. It is spraying water directly onto the parts that makes this system work. And while both have a design which sprays, neither previous systems have used it for a rinsing purpose. They do not employ this combination flooded/spray rinse design.

While there are four components to the immersion spray and rinse system; ST barrel, rinse tank, holding tank and a PLC controlled pump additional parts and components may be added. While a holding tank can be positioned differently or the immersion rinse water can be channeled to different places.

Data and flow charts: The rinse analysis tables 1 and 2 determines that equilibrium is met after the $66^{th}$ rinse cycle and as long as parts are determined clean enough, the amount of incoming water vs a barrel's drag-out will constantly achieve the desired results.

Times for immersion, and both fresh water sprays are variable and depend on 'loads per hour'. For one embodiment, if a line is producing 6 loads per hour, it is then understood that the hoist will visit the rinse tank every ~10 minutes (~60 min/6). The user then has ~10 minutes to run the sequence of 11 steps needed to produce the rinse but has control of changing the program within the ~10 minutes. One embodiment is to finish the rinsing process as the hoist returns to pick up the rinsed barrel, which does not allow parts to prematurely dry of which can produce stains. The time frames and rinse levels are variable but the time it takes to move water must be accounted for. The range of the immersion, waste, first spray, pause, second spray, and fill for immersion times and levels may be adjusted, accordingly.

TABLE 1

Time Calculations

| Demo Timeline | Seconds | Rinse Level Gallons | Valve Position |
|---|---|---|---|
| Immersion | 60 | 32 | No Flow |
| To Waste | 25 | 22 | To Waste |
| Remove Water | 24 | 14 | Drain Rinse Cycle |
| First Spray | 30 | 19 | Spray |
| Pause (Remove) | 30 | 14 | Drain Rinse Cycle |
| Second Spray | 30 | 19 | Spray |
| Fill for Immersion | 26 | 32 | Fill Rinse Cycle |
| | 3.74 | Minutes | |
| | 60 | Valve Switch Time | |
| | 4.74 | Minutes Total Cycle Time | |

TABLE 2

| Pump GPM | Spray GPM | Cylinder Radius Inch | Spray Volume GPM | Gallons inch | Max Rinse Level |
|---|---|---|---|---|---|
| 20 | 10 | 5 | 10 | 2.6 | 19 |

Computer Implemented Component or System

As used in this application, the terms "component" and "system" are intended to refer to a computer-related entity, either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution, and a component can be localized on one computer and/or distributed between two or more computers.

Generally, systems may include program modules, which may include routines, programs, components, data structures, etc. that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the innovation may also be practiced in distributed computing environments where certain tasks are performed by remote processing devices that are linked through a communications network. In a distributed computing environment, program modules can be located in both local and remote memory storage devices.

A computer typically includes a variety of computer-readable media. Computer-readable media can be any available media that can be accessed by the computer and includes both volatile and nonvolatile media, removable and non-removable media. By way of example, and not limitation, computer-readable media can comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

Software includes applications and algorithms. Software may be implemented in a smart phone, tablet, or personal computer, in the cloud, on a wearable device, or other computing or processing device. Software may include logs, journals, tables, games, recordings, communications, SMS messages, Web sites, charts, interactive tools, social networks, VOIP (Voice Over Internet Protocol), e-mails, and videos.

In some embodiments, some or all of the functions or process(es) described herein and performed by a computer program that is formed from computer readable program code and that is embodied in a computer readable medium. The phrase "computer readable program code" includes any type of computer code, including source code, object code, executable code, firmware, software, etc. The phrase "computer readable medium" includes any type of medium capable of being accessed by a computer, such as read only memory (ROM), random access memory (RAM), a hard disk drive, a compact disc (CD), a digital video disc (DVD), or any other type of memory.

All publications and patent applications mentioned in this specification are herein incorporated by reference to the same extent as if each individual publication or patent application was specifically and individually indicated to be incorporated by reference.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A method of immersing and spraying a barrel, comprising:

disposing a barrel into a rinse tank and partially flooding the rinse tank to a height F with contaminated water;

revolving the barrel in contaminated rinse water for a first rinse;

discharging a counterflow volume W to a waste stream;

discharging a remainder of volume H in the rinse tank to a holding tank;

spraying a first water spray over the inside of the barrel;

spraying a second water spray over the inside of the barrel;

removing the barrel from the rinse tank; and pumping a portion of contaminated water in the holding tank back to the rinse tank.

2. The method of claim 1, further comprising charging the rinse tank a volume F.

3. The method of claim 2, further comprising:

operably coupling the rinse tank with a plurality of valves, a pump, the holding tank and a Programmable Logic Controller (PLC);

including a receiver and a bracket in the rinse tank, and the bracket for receiving the barrel, and including a spray system with the rinse tank for spraying the barrel, extending the bracket down from a V saddle to a pre-determined height where the bracket is a Z bracket including an inward facing lower shelf, supporting a spring loaded male connector with the inward facing lower shelf and accepting flow from an outside source by the spring loaded male connector, including a female connector that mates with the spring loaded male connector;

storing the contaminated rinse water in the holding tank and including an overflow drain, a water sensor to sense a level of water in the holding tank;

controlling the pump and the plurality of valve to direct water and forth from the holding tank to the rinse tank and to waste, sending instructions for how long a valve stays open and in what direction the pump pushes water;

including a rotation system to rotate the barrel during the first rinse in the rinse tank; after a pre-determined period of time, pumping a first amount of water from the rinse tank to waste wherein the first amount of water pumped to the waste stream is equal to an amount sprayed in the first water spray by the spray system on the barrel in the rinse tank;

pumping a second amount of immersed water to the holding tank leaving a space W between a bottom of the barrel and the water level in the rinse tank; and rotating the barrel as a second amount of water from the second spray is pumped through the spray system.

4. The method of claim 3, wherein the spray system is selected from the group consisting of a spray bar or a spray cap.

5. The method of claim 4, further comprising coaxially disposing the spray bar through the barrel; and including a series of uniformly drilled downward facing perforations in the spray bar that sprays at least across a length of the barrel.

6. The method of claim 4, further comprising engaging the spray cap into a fixed shaft that sprays across a load of the barrel.

* * * * *